US008801248B2

(12) United States Patent
Brendle

(10) Patent No.: US 8,801,248 B2
(45) Date of Patent: Aug. 12, 2014

(54) LAMP MODULE FOR A GLARE-FREE MOTOR VEHICLE HIGH BEAM

(71) Applicant: Automotive Lighting Reutlingen GmbH, Reutlingen (DE)

(72) Inventor: Matthias Brendle, Tuebinger (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 7 days.

(21) Appl. No.: 13/767,474

(22) Filed: Feb. 14, 2013

(65) Prior Publication Data

US 2014/0056018 A1 Feb. 27, 2014

(30) Foreign Application Priority Data

Feb. 15, 2012 (DE) ..... 10 2012 202 290

(51) Int. Cl.
*F21V 7/00* (2006.01)
*F21S 8/10* (2006.01)

(52) U.S. Cl.
CPC ..... *F21S 48/1159* (2013.01)
USPC ..... 362/516; 362/518; 362/545

(58) Field of Classification Search
CPC ..... F21S 48/1159; F21S 48/1154
USPC ..... 362/516, 518, 543, 545
See application file for complete search history.

(56) References Cited

U.S. PATENT DOCUMENTS

| | | | | |
|---|---|---|---|---|
| 7,543,964 | B2 * | 6/2009 | Albou | 362/298 |
| 7,959,336 | B2 * | 6/2011 | Iwasaki | 362/517 |
| 8,632,233 | B2 * | 1/2014 | Kawamura | 362/539 |
| 2002/0118548 | A1 * | 8/2002 | Kuenstler et al. | 362/518 |
| 2009/0097269 | A1 * | 4/2009 | Stauss et al. | 362/539 |

FOREIGN PATENT DOCUMENTS

| | | | |
|---|---|---|---|
| DE | 102004012184 | A1 | 12/2004 |
| DE | 102008013603 | A1 | 9/2009 |
| DE | 202010003058 | U1 | 6/2010 |
| DE | 102009035544 | A1 | 2/2011 |
| DE | 102010023360 | A1 | 4/2011 |
| EP | 2306074 | A2 | 4/2011 |

OTHER PUBLICATIONS

Oct. 30, 2012 Examination Report for DE 10 2012 202 290.2.

* cited by examiner

*Primary Examiner* — Evan Dzierzynski
(74) *Attorney, Agent, or Firm* — Howard & Howard Attorneys PLLC

(57) ABSTRACT

A lamp module for a motor-vehicle headlamp. The lamp module comprises a light source defining at least one light-emitting surface that emits a luminous flux and defines a horizontally oriented longitudinal edge and at least one other edge running at a right angle thereto. A reflector maps the light-emitting surface without generating an actual intermediate image in front of the lamp module and defines at least two reflecting and strip-shaped facets longitudinal axes of which are more parallel rather than transversal to the longitudinal edge of the light-emitting surface and disposed at a spacing to the light source where the light-emitting surface is mapped with the same mapping scale in front of the lamp module such that the light-emitting surface is mapped with a longitudinal edge running horizontally and another edge running vertically.

20 Claims, 6 Drawing Sheets

LAMP MODULE FOR A GLARE-FREE MOTOR VEHICLE HIGH BEAM

CROSS-REFERENCE TO RELATED APPLICATION

This application is based upon and claims priority to German Patent Application 10 2012 202 290.2 filed on Feb. 15, 2012.

BACKGROUND OF INVENTION

1. Field of Invention

The invention relates to a lamp module for a motor-vehicle headlamp having a light source exhibiting at least two light-emitting surfaces each of which emits a luminous flux that can be controlled individually.

2. Description of Related Art

A lamp module of this type is known from, for example, EP 2 306 074, and suitable for generating a glare-fee high beam for motor vehicles. A glare-free high beam is understood to be high-beam light distribution in which partial regions can be dimmed if there is someone located in these partial regions who could be blinded therefrom. This could be, for example, the driver of a preceding or oncoming vehicle. A lighting function of this type is referred to a "partial high beam."

The invention serves to, in particular, provide a high beam of this type without the need for mechanically complex and expensive adjustment systems.

Projection systems axe known in this context, the light sources of which include a configuration of individually controllable light-emitting diodes. A configuration of this type shall be referred to in the following as a "matrix." A headlamp that exhibits a configuration of this type is also referred to as a "matrix headlamp."

With the known systems, an intermediate image lying within the headlamp is generated from the light-emitting surfaces of the light-emitting diodes using a primary lens, which is subsequently projected onto the street in front of the lamp by a secondary lens system exhibiting a projection lens, as the light distribution of the headlamp in its forward region. By switching light-emitting diodes "off," partial, regions of the light distribution can be dimmed in a controlled manner. A system of this type is known from, for example, DE 2008 013 603.

With DE 10 2010 023 360, a glare-free high beam has been realized using an LED matrix (LED=light-emitting diode), in which the individual LEDs are separately disposed as "surface-mounted devices" (SMD-LEDS) (components separately disposed at a spacing from one another). The resulting separation of the light-emitting surfaces of the LEDs is rectified by a matrix of primary lenses, which generates an intermediate image from the separated light-emitting surfaces in the form of a coherently bright area. Due to the imprecisions in the positioning of the SMD-LEDs, unfavorable conditions for the generation of a good intermediate image exist, which primarily is to be distinguished by its homogeneity and sharply focused edges of its partial regions formed by individual LEDs.

Other problems arise with systems of this type in that the light-retracting secondary lenses inevitably generate undesired color fringes at "light/dark" borders. This, then, becomes critical when, in particular, it has not been determined on which side of the "light/dark" border the bright region is located because this can vary depending on the traffic situation. To prevent such color fringes with a matrix headlamp having a light-refracting projection lens, it is known from the aforementioned EP 2 306 074 A that achromatic lenses made of two lenses can be used, increasing the weight and costs for a headlamp.

With this background, an objective of the invention includes providing a lamp module for a motor-vehicle headlamp with which a glare-free high beam can be generated and that does not exhibit the aforementioned disadvantages (or exhibits any of them to only a slight degree). Reflectors are also a fundamental possibility, but they are accompanied by other problems.

SUMMARY OF INVENTION

The invention overcomes disadvantages in the related art in a lamp module for a motor-vehicle headlamp. The lamp module comprises a light source defining at least one light-emitting surface that emits a luminous flux and defines a horizontally oriented longitudinal edge and at least one other edge running at a right angle thereto. A reflector maps the light-emitting surface without generating an actual intermediate image in front of the lamp module and defines at least two reflecting and strip-shaped facets longitudinal axes of which are more parallel rather than transversal to the longitudinal edge of the light-emitting surface and disposed at a spacing to the light source where the light-emitting surface is mapped with the same mapping scale in front of the lamp module such that the light-emitting surface is mapped with a longitudinal edge running horizontally and another edge running vertically.

The lamp module according to the invention is distinguished, in particular, in that the light-emitting surfaces border one another directly disposed in a row that is oriented horizontally with the intended application of the lamp module in the motor vehicle and it exhibits a reflector that is equipped and disposed to map the light-emitting surfaces of the light source without generating an actual intermediate image in front of the lamp module, which exhibits at least two reflecting and strip-shaped meets. The longitudinal axes of the facets are oriented more parallel rather than transversal to the row of light-emitting surfaces and, in each case, are disposed at a distance from the light source, where they map the light-emitting surfaces with the same mapping scale in font of the lamp module. A single light-emitting surface, in each case, is mapped as a vertically oriented and coherent strip in the light distribution formed as an image of the light-emitting surface.

In that the light-emitting surfaces directly bordering one another are disposed in a row, a coherent light-emitting surface of the light source is already obtained within the headlamp without the need for a primary lens that, with one or the other headlamps of the prior art, first generates a coherent intermediate image including individual light-emitting surfaces of light-emitting diodes.

The horizontal configuration of the light-emitting surfaces is transferred, with the invention, to the configuration of its images in the light distribution in front of the lamp module on the street. By tire horizontal configuration of the light-emitting surfaces, it is possible (in conjunction with the individual controllability of the luminous flux via the respective light-emitting surfaces) to dim partial regions of the high-beam-light distribution in the horizontal plane (with a width depending on one of the numerous light-emitting surfaces) in a controlled manner to reduce the danger of blinding or brighten in a targeted manner to generate a "spotlight" type narrow strip of light. The partial regions vary in terms of their horizontal positions in the light distribution. In this respect, it is possible to distinguish partial regions that are more to the right, more to the left, or substantially in the center.

Because the mapping takes place by a reflector without generating an actual intermediate image, installation times are eliminated, which are necessary with systems functioning with an intermediate image for generating the intermediate image between a primary lens and a projection lens. The use of a reflector in place of a lens has the advantage that chromatic aberrations occurring with refracting lenses are eliminated. Furthermore, reflectors can be more easily and cost-effectively produced than lenses and do not cause any undesired diffusion as a result of "Fresnel effects." On the other hand, reflectors have the disadvantage that with larger numbers of apertures, aperture failures occur. This also applies to refractive lenses, but, in this case, can be corrected with more lenses.

In addition, different reflector zones have different enlarging effects such that the images generated by them exhibit different mapping scales. Moreover, with abaxial beams, offsetting occurs, thus resulting in coma. A quadratic light source or light-emitting surface is then not mapped as a square, but, rather, as a trapezoid or distorted to a mushroom shape, wherein the size, position, and orientation of the light-source images in the image space are strongly dependent on the position of the light source in the object space.

A system that is to generate numerous light distributions from numerous light-emitting surfaces (composed of lineal and sharply bordered images from individual light-emitting surfaces in the form of a mosaic having a defined position for "light/dark" borders) must primarily have characteristics that map in a manner that is true to shape and position. A light distribution of this type, therefore, should, in particular, be constructed from images of the individual light-emitting surfaces having the same size and same orientation.

This is achieved with the invention in that the reflector exhibits at least two reflecting and strip-shaped facets the longitudinal axes of which are oriented to be more parallel rather than transversal to the row of light-emitting surfaces and, in each case, disposed at a spacing from the light source, where they map the light-emitting surfaces with the same mapping scale in front of the lamp module. A single light-emitting surface, in each case, is mapped as a vertically oriented and coherent strip in the light distribution adjusted as an image of the light-emitting surface.

With the invention, the light-emitting surfaces are mapped without front lenses and shutters by using a specialized reflector, which ensures that the images generated from different regions of the reflector are at least nearly identical in size.

This is not necessarily the case. With a simple parabolic shape, the problem arises that images originating from close to the vertex are larger than images generated from regions lying further away from the vertex of the reflector. As a result, it is not possible to generate a sufficiently sharp vertical "light/dark" border.

A partial high beam (composed of individual strips each of which is generated by a direct mapping, without generating an intermediate image, of a light source exhibiting different light-emitting surfaces) requires a constant width of the strip over the course of the length of the strip. The invention enables the generation of a partial high beam of this type having a significantly lower number of components in comparison with the prior art, which represents an advantage with respect to the cost expenditures, assembly and adjustment expenditures, and weight. Through the combining of numerous light-emitting surfaces in a reflector or a reflector chamber the coherent reflector surfaces of which are illuminated by luminous fluxes from numerous light-emitting surfaces, an extensive adjustment of the individual strips in relation to one another during the assembly is also eliminated. Numerous lamp modules can be combined with one another. In this case, an adjustment of the lamp module is provided.

Other objects, features, and advantages of the invention are readily appreciated as it becomes more understood while the subsequent detailed description of at least one embodiment of the invention is read taken in conjunction with the accompanying drawing thereof.

BRIEF DESCRIPTION OF EACH FIGURE OF DRAWING OF INVENTION

DETAILED DESCRIPTION OF EMBODIMENTS OF INVENTION

Identical reference symbols in different figures indicate the same components or at least components having the same functions.

Figure 1:
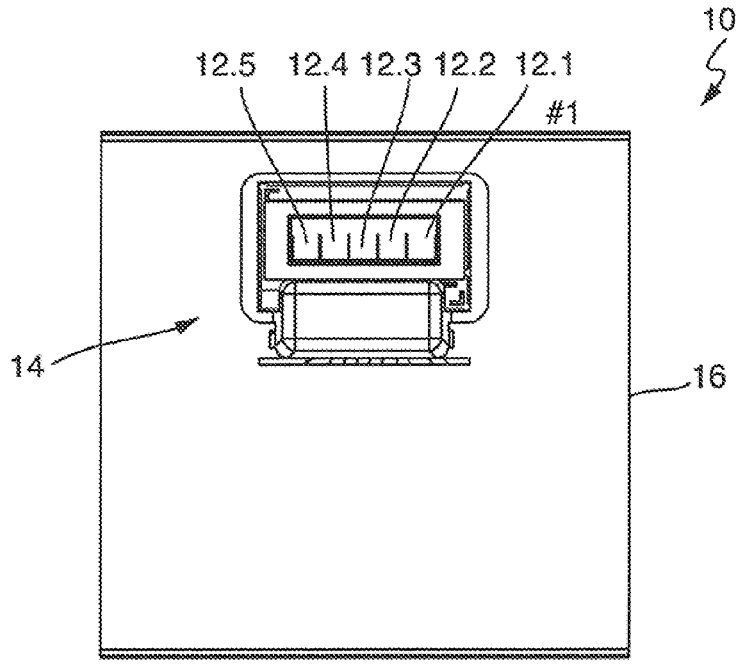
FIG. 1 is a top view of a light source exhibiting "n=5" light-emitting surfaces.

FIG. 1 shows a top view of a light source 10 having "n=5" light-emitting surfaces 12.1-12.5. It is understood that "N" can be any natural number greater than or equal to 1.

In an embodiment, each light-emitting surface belongs to one LED chip (LED=light-emitting diode). The LED chips are installed on a common interconnect device 14. The supply of electric energy and the control are obtained via the interconnect device.

The LEDs can be individually controlled as single units and/or in groups such that the luminous flux emitted from each light-emitting surface can be controlled individually. The controllability includes, thereby, in an embodiment, not only a switching between permanently "on" and permanently "off," but also a control of the brightness, which, for example, can take place by an activation with a duty cycle having a signal frequency that is high enough that the human sense of vision perceives an average brightness. The main beam direction of the light is oriented perpendicular to the depicted plane and to the observer in the subject matter of FIG. 1.

Each individual light-emitting surface is rectangular in an embodiment (specifically, square). The lengths of the edges are between 0.3 and 2 mm. In an embodiment, the light-emitting surface is flat. LEDs emitting white light having these characteristics are used serially in motor-vehicle headlamps (or at least as an option) and are, thereby, available.

The LED chips lie directly adjacent to one another such that their light-emitting surfaces abut to the greatest degree possible. For this, they are disposed such that edges of neighboring light-emitting surfaces opposite one another are parallel. They are, in particular, disposed horizontally in a plane along a horizontal line, wherein the reference to the horizon is obtained here in a pre-defined intended use of the lamp module in a motor vehicle.

"Disposed directly adjacent to one another" is understood here to mean, in particular, that the light-emitting surfaces are directly neighboring, and activated LEDs are not perceived as separate light-emitting surfaces by observers.

Figure 3:
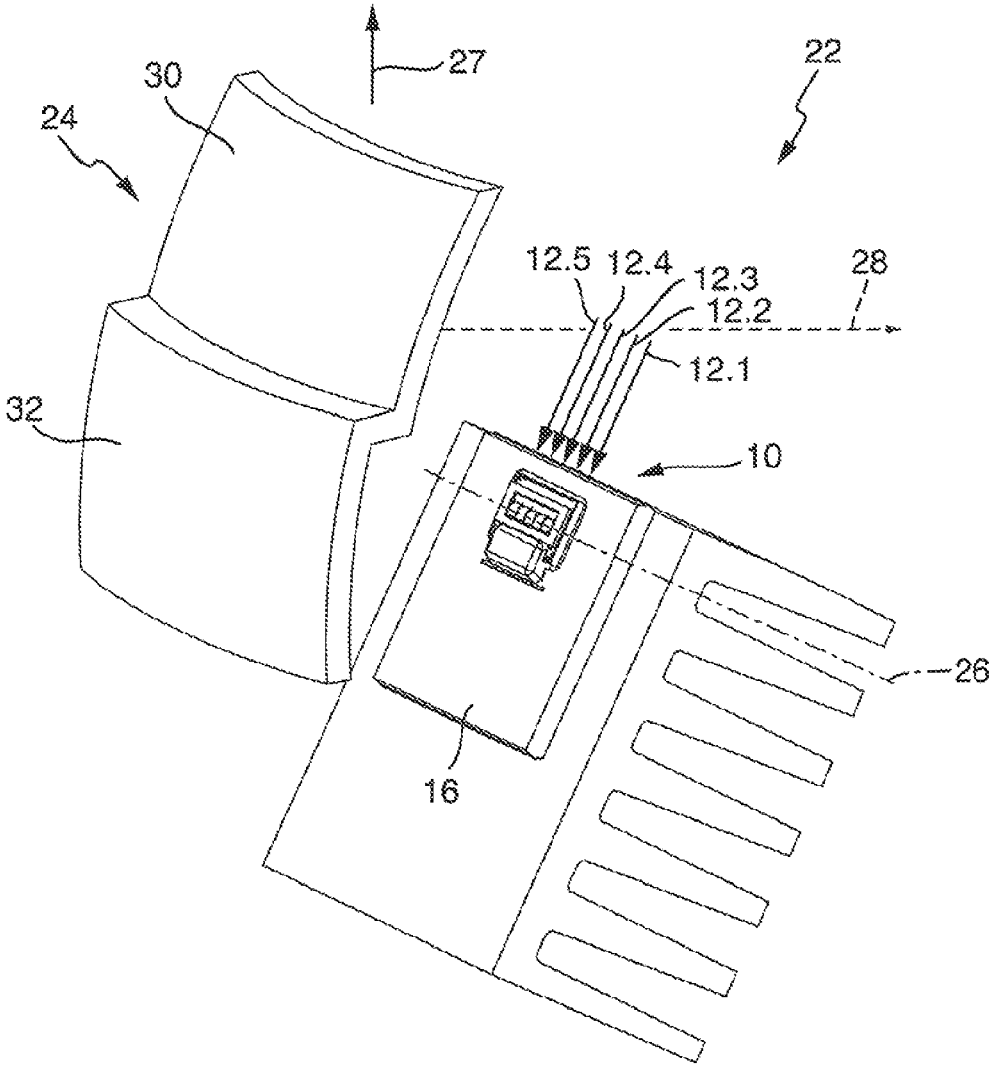
FIG. 3 is a perspective view of the substantial components of an embodiment of a lamp module according to the invention.

The interconnect device is attached to a cooling element such that the cooling element can accommodate hear discharged in the chips when the LEDs are in operation. The cooling element is configured in terms of its heat capacity and shape to accommodate this heat and discharge the heat into the environment, wherein the discharge occurs, in particular, via structures having a large surface area (i.e., via cooling fins, as is depicted in FIG. 3).

The light-emitting surfaces can be "exit" ends of fiber optics, which are individually supplied with light via light-entry surfaces lying spatially separated from, the light-emitting surfaces.

Figure 2:
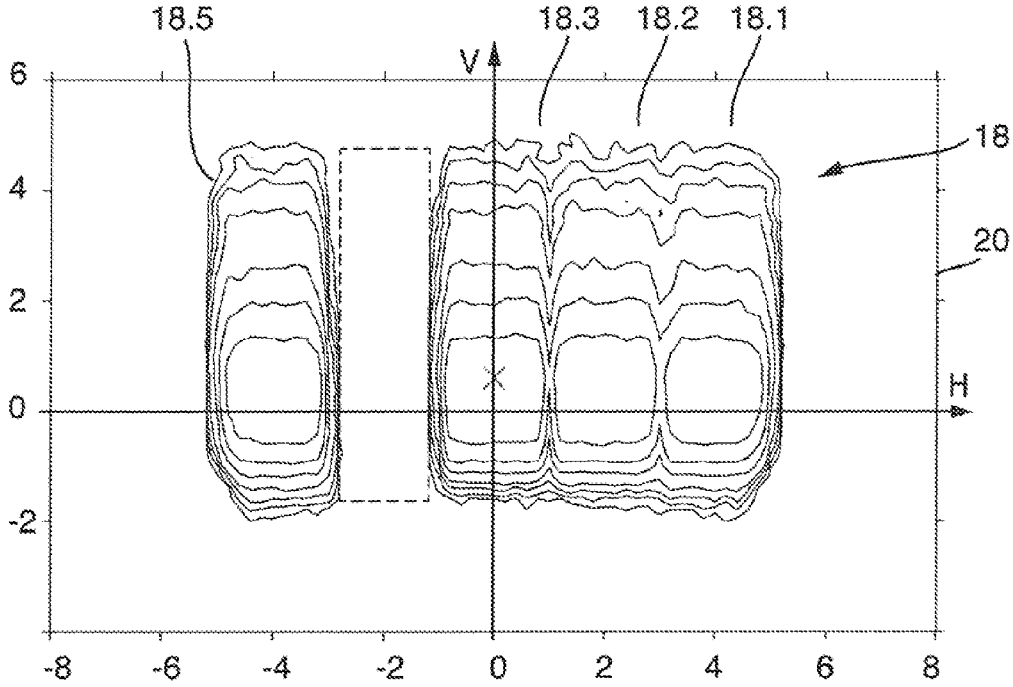
FIG. 2 is an example of a partial-high-beam light distribution as is generated by an embodiment of a lamp module according to the invention.

FIG. 2 shows an example of a partial-high-beam distribution as it is generated by one embodiment of a lamp module according to the invention. The light source of the lamp exhibits "n=5" light-emitting surfaces.

A light distribution of this type is obtained on a flat measurement screen 20 (disposed in front of a motor vehicle oriented such that its surface norm lies in a hypothetical extension of a parallel to the longitudinal axis of the vehicle) in front of the vehicle. A horizontal line "H" marks the position of the horizon. A vertical line "V" divides the field in front of the lamp module into a right half and a left half. The units on both axes are angular.

The light distribution depicted in FIG. 2 is then obtained with an embodiment of a lamp module according to the invention having a light source exhibiting five light-emitting surfaces (when the fourth light-emitting surface does not deliver a luminous flux while the other four light-emitting surfaces do deliver a luminous flux). The light-emitting surfaces are numbered, increasing from right to left in FIG. 1.

Each light-emitting surface 12.1-12.5 generates a light distribution (with an activated LED, in the embodiment, in the form of a partial-high-beam strip 18.1-18.5) having a greater expansion in the vertical axis than in the horizontal axis. For this, the width measured parallel to the horizontal "H" of each of the strips is nearly constant. With the light distribution depicted in FIG. 2, four of the five LEDs are activated, and the fourth LED 12.4 is not activated. The rectangle indicated by a broken line represents the then-missing partial-high-beam strip of this LED.

FIG. 3 shows a perspective view of substantial elements of an embodiment of a lamp module 22 according to the invention. FIG. 3 shows in detail a configuration from a light source, such as is depicted in FIG. 1, and a reflector 24. The line 26 aligned with the light-emitting surfaces 12.1-12.5 is parallel to the horizon in an intended use of the lamp module in a motor vehicle in which, for example, the light distribution depicted in FIG. 2 is generated, thus oriented parallel to line "H" in FIG. 2. The broken line 28 marks a central axis of the lamp module that corresponds, for example, to the main beam of the lamp module and, in a hypothetical extension in front of the vehicle, passes through the intersection point of the horizontal "H" and the vertical "V" in FIG. 2.

FIG. 3 shows, thereby, a lamp module (in particular, for a motor-vehicle headlamp) having a light source that exhibits "n=5" light-emitting surfaces emitting, in each case, a luminous flux and that are directly adjacent to one another and disposed in a row, wherein the row is oriented horizontally in an intended use of the lamp module in motor vehicles.

Furthermore, FIG. 3 shows a reflector 24 having a first reflector end and strip-shaped facet 30 and a second reflector end and strip-shaped facet 32. The facets are oriented more parallel rather than transversal in their longitudinal axes in relation to the row of light-emitting surfaces. They are, in each case, disposed at a spacing that is uniform to the greatest extent possible from the light source, where they map the light-emitting surfaces with the same mapping scale in front of the lamp module as images of the light-emitting surfaces. For these reasons, the intended rectangular shapes of the partial-high-beam strips are obtained as images of the light-entitling surfaces of the LEDs. Blurred, trapezoidal, or other deformations are diminished or eliminated thereby. Moreover, focused "light/dark" borders (i.e., high-intensity gradients) are obtained.

The facets are configured, in particular, and (with respect to the shape of their reflector surfaces) shaped such that a single light-emitting surface of the light source in each case is mapped as a vertically oriented and coherent strip in the light distribution forming an image of the light-emitting surfaces. In doing so, the mapping of the light-emitting surfaces of the light source in front of the lamp module is obtained, in particular, without generating au actual intermediate image, as is the case with normal projection systems having a primary lens and a secondary lens.

Each facet, in an embodiment, exhibits a focal point and is configured to reflect light diverging from the focal point as a light bundle exhibiting substantially parallel light. With substantially parallel, it is to be understood here that the light with angles of beam spread is converted to a light distribution that is normal for light distributions conforming to the standard for motor vehicles for a non-pivotal high beam.

The reflector surfaces are, for the most part, parabolic and orient the light arriving from the focal point such that it is parallel. Because the light source is not punctiform, a diverging light bundle is obtained (FIG. 2). A high-beam light distribution is normally generated from numerous lamp modules according to the invention.

From FIG. 2, an angle of beam spread of two to three degrees for the horizontal angle width, for example, can be derived. In this case, the horizontal width of the overall light distribution is, specifically, approximately twelve degrees, which is obtained as the sum of the horizontal angle widths from five light-emitting surfaces (12/5=2.4). In the vertical axis, the angle width is somewhat more than six degrees, which is obtained approximately as the sum of the vertical angle widths of the light bundle-reflecting facets disposed above one another such that the deflection resulting from a single facet has a value less than six degrees. The individual strips overlap slightly in reality.

The characteristic exhibited by the reflector facets, which are oriented horizontally and disposed vertically above one another in their intended use, is fundamental. By this distribution of the reflectors to numerous facets (which, in an embodiment, exhibit "paraboloid" forms having different focal lengths from one facet to another with a common focal point and a common central axis as well as basically uniform spacing to the local point), only limited "aperture" errors occur for beams close to the axes (i.e., for beams that arrive from the focal point and from close to the focal point). The common focal point of the facets, in an embodiment, lies in the center of the light-emitting surfaces of the light source.

The individual facets 30, 32, in an embodiment, have the shape of a section of a paraboloid of revolution in the shape of a strip. The edges bordering the respective strip in the vertical plane and in the horizontal plane correspond, in an embodiment (as is also depicted in FIG. 3), to lines of intersection, which result in fulfilled intersections that are parallel to the axis of rotation of the paraboloid. In an embodiment (depicted in FIG. 3), in each case, two parallel planes and two planes crossing these form a right angle.

With respect to the relative configuration of the reflector 24 and the light source 10, in an embodiment, the light-emitting surfaces are disposed such that they are adjacent to one another and directly border one another in a row, which is oriented at a right angle to the central axis 28 and parallel to a longitudinal axis of the strip-shaped facets of the reflector. The longitudinal axis of the facets is parallel to line 26 in FIG. 3. The lines 26, 28 form a plane. A third axis 27 is oriented to this plane in the normal manner. The strip-shaped facets lie in the plane of this third (vertical) axis with their longitudinal surfaces bordering one another adjacently, which corresponds to a stacked configuration in the intended use.

The line 26, aligned along the light-emitting surfaces 12.1-12.5, is parallel to the horizon in an intended use of the lamp module in a motor vehicle in which, for example, the light distribution depicted in FIG. 2 is generated (i.e., oriented such that it is parallel to line "H" in FIG. 2.)

With respect to the configuration of the facets in relation to one another, in an embodiment, they are disposed adjacently to one another such that they are directly neighboring one another in a plane perpendicular to the longitudinal axis of the facets and to the central axis.

Figure 4:
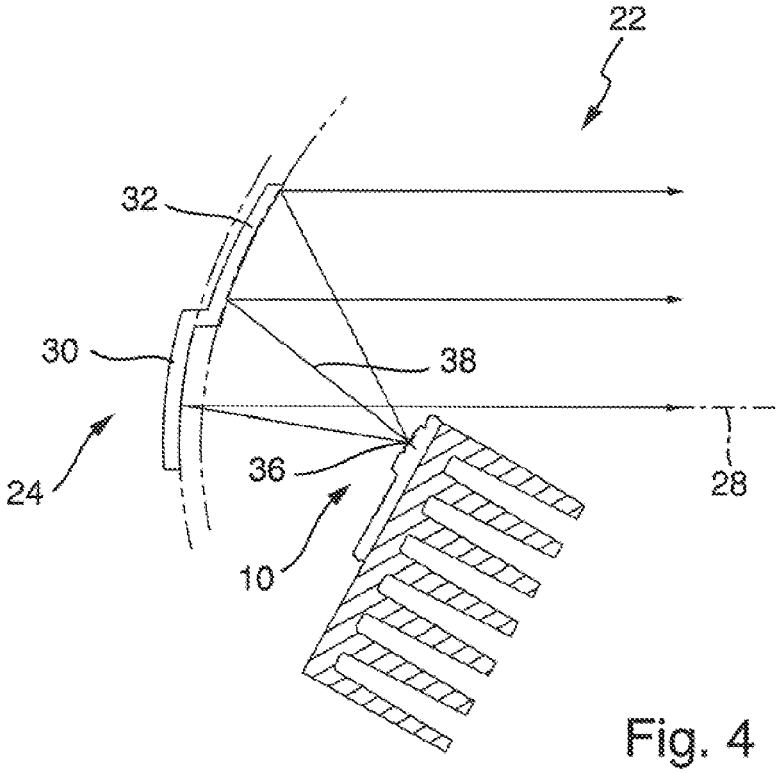
FIG. 4 is a vertical plane through a lamp module the reflector of which exhibits two facets.

FIG. 4 shows a vertical plane through an embodiment of a lamp module 22 according to the invention the reflector 14 of which exhibits two facets 30, 32.

Figure 5:
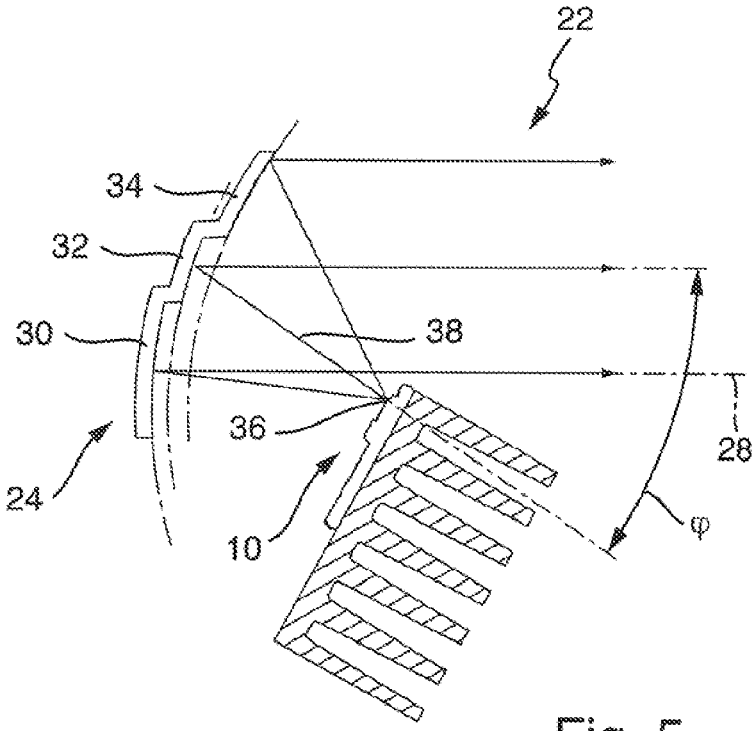
FIG. 5 is a vertical plane through a lamp-module the reflector of which exhibits three facets.

FIG. 5 shows a vertical plane through an embodiment of a lamp module 22 according to the invention the reflector 14 of which exhibits three facets 30, 32, 34.

That the individual facets, in an embodiment, have the shape of a section from a paraboloid of revolution in the form of a strip applies here as well. When the number of facets lying on top of one another is increased, the vertical angle width, which is filled by the light bundle of a facet, can be reduced accordingly. The horizontal width can accordingly also be better maintained at a constant value as well. The broken lines, which are each continuations of the shape of the facets in the vertical plane, are parabolas in an embodiment.

The facets are, in an embodiment, disposed such that the optical axis of each facet coincides with the optical axis of each of the other facets. The optical axis, in an embodiment, corresponds to the axis of rotation of the paraboloid, which determines the shape of the facets. This axis of rotation, in an embodiment, is aligned to the central axis 29 and, thereby, to the main axis of light emission of the lamp module or at least lies parallel to the central axis 28.

In an embodiment, the facets of a reflector are disposed such that the focal point of each arbitrary facet of the reflector coincides with the focal point of each arbitrary other facet of the reflector in a common focal point 36.

It is necessarily the case that the focal length of the facets decreases from one facet to the next as the spacing from the central axis 28 increases. The vertical planes are, in an embodiment, substantially parabolas with different focal lengths and a common focal point. Of course, small deviations from the shape of a parabola are allowed as long as the optical effect, as expressed in the light distribution in front of the vehicle, is not impaired such that, in particular, the standard conformity is no longer obtained. Small deviations could even serve to improve the conformity to the standard. As a rule, however, in an embodiment, the "paraboloid" shape has the required mapping characteristics. In an embodiment, the "paraboloid" shape constitutes at least fifty percent of the surface of the facets.

That the focal length of the paraboloid strips lying farther out then automatically becomes shorter can be derived from the following: With an increasing spacing from the vertex, a parabola increasingly distances itself from an arc that abuts the parabola at its apex and has there the same tangents and norms. To compensate for the increasing distance (which would distort the mapping), a narrower parabola may be used (i.e., a parabola having art increased "expansion" factor "a" with a parabola of "$y=ax^2$"). Because the focal length "$f=(1/4)a$" is inversely proportional to the expansion factor "a," an enlargement of the expansion factor is accompanied by a shortening of the focal length.

The common focal length 36 in the design, depicted in FIGS. 4 and 5, lies in the center of the light-emitting surface of the light source formed by all of the individual light-emitting surfaces collectively.

In an embodiment, the light source is disposed in relation to the reflector such that the main beam directions of its at least two light-emitting surfaces (each emitting one luminous flux) are directed onto the facets of the reflector and form an acute angle with the central axis of the reflector (in particular, an angle "$\phi$" of less than 45°). This applies to an angle that lies in the drawing, plane of FIGS. 4 and 5. For this, it can be assumed that the light source shadows a portion of the beam path.

Figure 6:
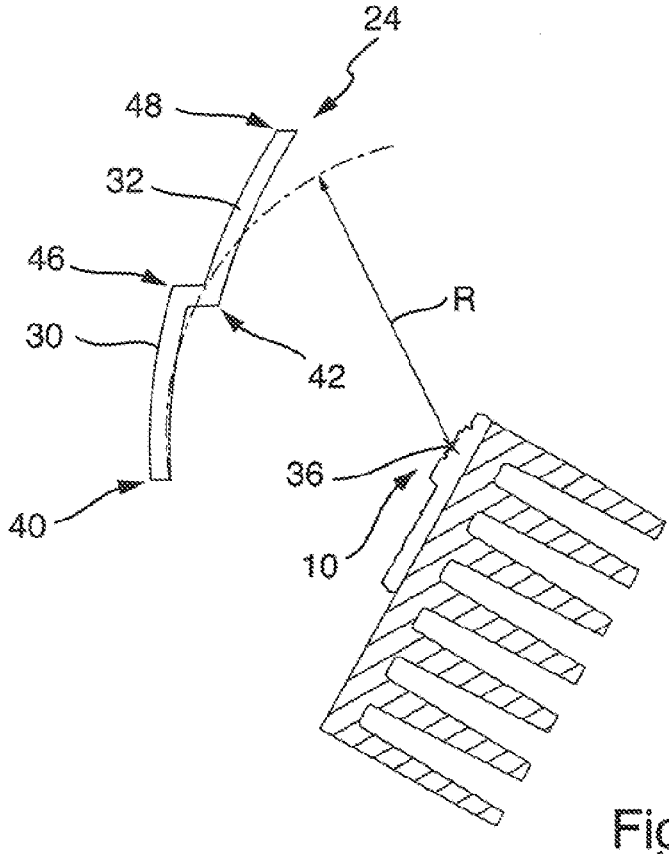
FIG. 6 is a design having an equal spacing for all facets from a common local point for a lamp module having two facets.
Figure 7:
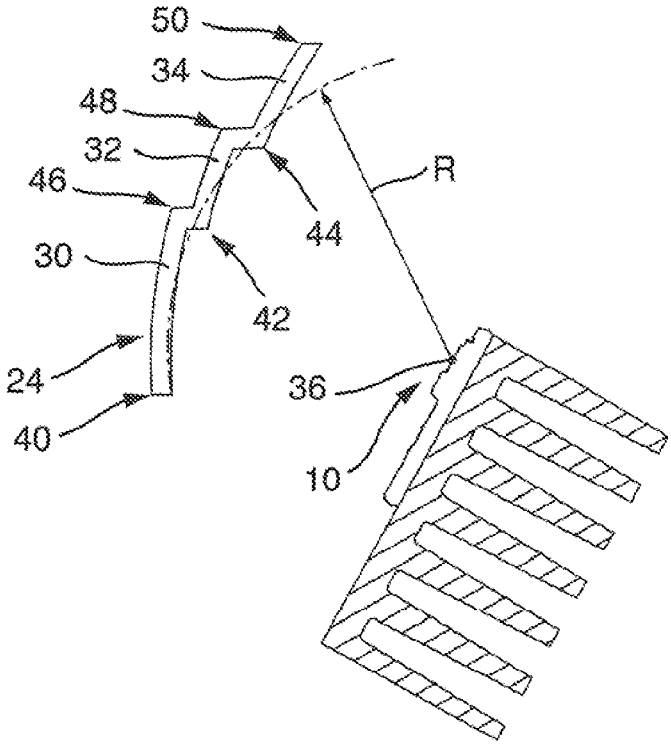
FIG. 7 is a design like that in FIG. 6, but having a reflector exhibiting three facets.

FIGS. 6 and 7 show art embodiment in which a spacing "R" of a facet 32 to the common focal point **3*d* is the same as a spacing "R" for each of the other facets 30 to the common focal point. FIG. 6 relates to a design having two facets 30, 32, and FIG. 7 relates to a design having three facets 30, 32, 34. Because the mapping scale depends on the spacing "R," a uniform average scale "R" for the mapping of the light-emitting surfaces of the light source 10 through the various facets is obtained. If the same spacing is set in each case for a lower edge 40, 42, 44 of the facets 30, 32, 34**, then the upper edge of a facet must inevitably always have a slightly larger spacing from the focal point than the lower edge of the facet. This is derived from the fact that the parabolic cross-sections of the facets have a curvature that decreases from the lower edge to the upper edge while the arc having a radius "R" (representing the average spacing) has a constant curvature.

Figure 8:
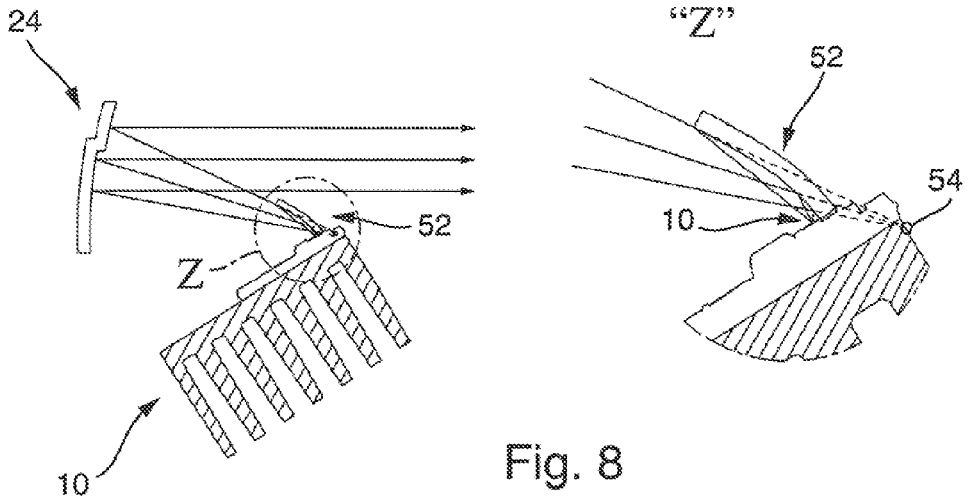
FIG. 8 is a design having a supplementary lens in the form of a convergent mirror.

FIG. 8 shows a design having a supplementary lens in the form of a convergent mirror 52 disposed in the beam path between the light source 10 and the (main) reflector 24. The concave mirror reflects the light arriving from the light source 10 at an acute angle to the central axis of the reflector 24 into the reflector 24. If one observes the beam path in the reverse direction, the reflector 24 focuses on a point lying behind the light source 10 in this configuration and generates an enlarged virtual image of the light source behind the light source 10. In this case as well, the light source lies between the local point of the reflector (point 54) and the reflector surface of the reflector 54.

Figure 9:
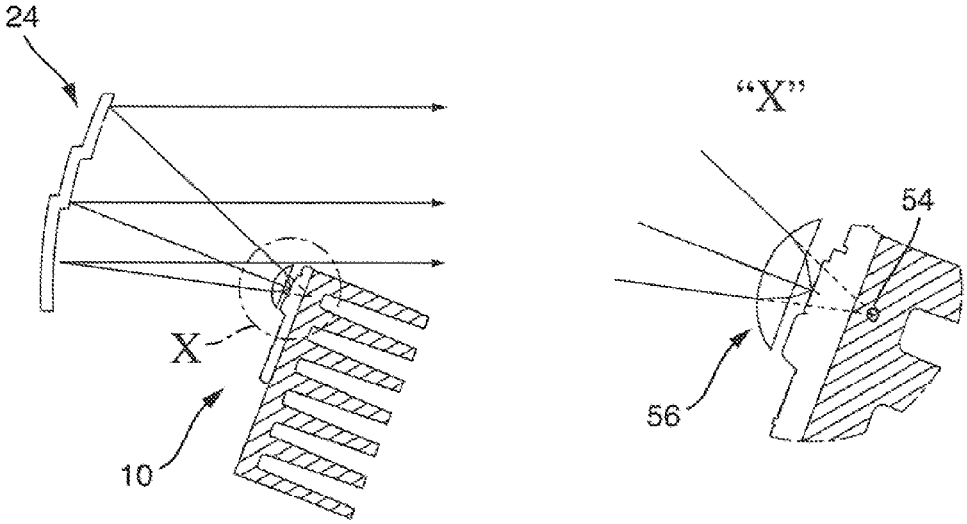
FIG. 9 is a design having a supplementary lens in the form of a convergent lens.

FIG. 9 shows a design having a supplementary lens in the form of a convergent lens 56 disposed in the beam path between the light source 10 and the reflector 24.

The convergent lens 56 bundles the light arriving Torn the light source 10. The bundle then falls on the reflector 24 at an acute angle to the central axis of the reflector. If one observes the beam path in the reverse direction, then the reflector 24 focuses on a point 54 lying behind the light source 10 in this configuration and generates an enlarged virtual image of the light source behind the light source. The light source in this design is disposed between the focal point of the reflector 54 and the reflector surface of the reflector 24.

The convergent lens 56 is, in an embodiment disposed such that it reinforces the bundling effect of the reflector 24. This configuration is depicted in FIG. 9 and causes a leveling of the "Petzval" surface at the light-source end of the configuration. The "Petzval" surface can be perceived as the surface that is mapped with a sharp focus by the lens system. This "Petzval" surface is normally curved in a single lens element. A system constructed of numerous lens elements can exhibit a flat "Petzval" surface if the "Petzval" sum equals zero.

Figure 10:
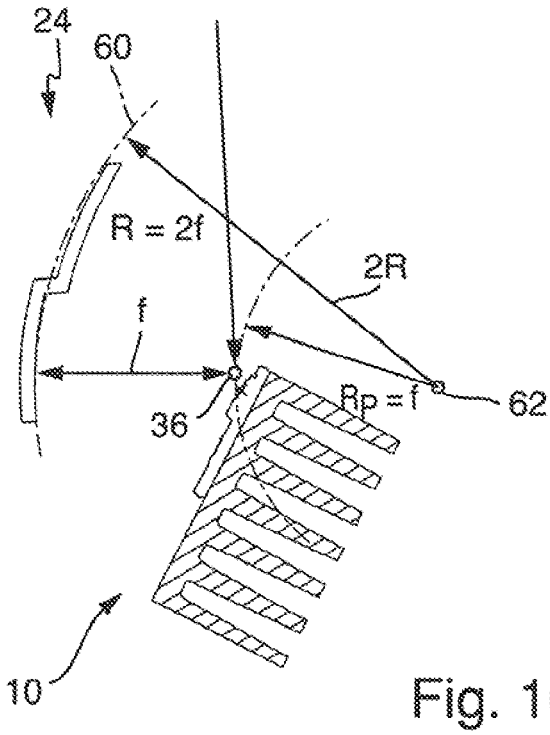
FIG. 10 is the convex "Petzval" surface of the reflector.

FIG. 10 illustrates a curvature of the "Petzval" surface 60 of the reflector 24. This "Petzval" surface 60 lies on a spherical surface 60 the radius of which "2R" is twice as large as the focal length "f" of the paraboloid the vertex of which is abutted by the spherical surface 60. The center point of the sphere of the spherical surface 60 is derived from the specified point of contact in the vertex of the paraboloid, focal length "f" of the paraboloid, and requirement that the vertex is a point of contact on the spherical surface 60 because this defines the surface norm, which is oriented toward the center 62 of the sphere. As the vertical plane depicted in FIG. 10 shows, the "Petzval" surface 60 of the reflector 24 is curved to the right in the depicted configuration.

Figure 11:
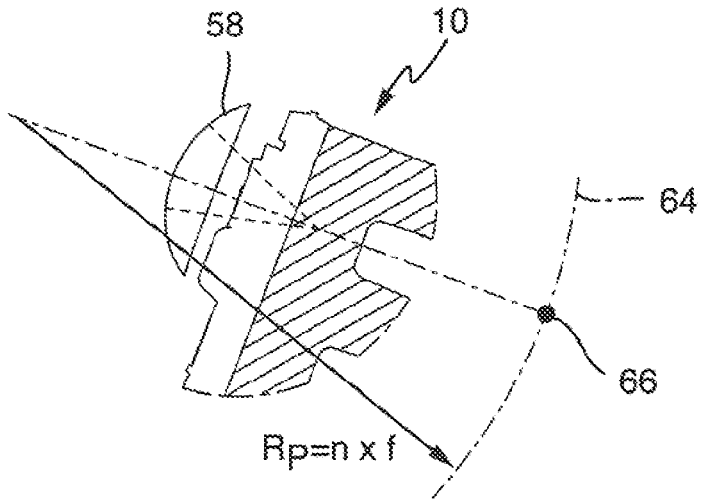
FIG. 11 is the "Petzval" surface of the convergent lens in the configuration according to FIG. 9.

FIG. 11 illustrates the "Petzval" surface 64 of the convergent lens 58 in the configuration according to FIG. 9. Here as well, the "Petzval" surface 64 passes through the local point 66 of the associated lens (in this case, the convergent lens 58) and exhibits a curvature. This "Petzval" surface 64 has a curvature to the left in the depicted configuration and is, therefore, curved in the opposite direction of the curvature of the "Petzval" surface 60 of the reflector 24.

By the supplementary lens in the form of a convergent lens 58, the object plane of the lens system can be leveled such that the light-emitting surfaces having a greater spacing to the parabolic focal, point can be mapped with a sharp focus. The light-emitting surfaces (in particular, the light-emitting surfaces of LED chips), in an embodiment, lie in a single plane because this is advantageous from the perspective of production expenditures than a configuration on a curved surface in space (in which, for example, a flat circuit board for the electrical connection of all of the LED chips could not be used). A convex mirror (i.e., a parabolic mirror) functions in this sense in the same manner as that of a convergent lens.

To level the object field, the curvatures of the "Petzval" surfaces of the individual lens elements must decrease to the greatest extent possible (i.e., the "Petzval" sum as a sum of the reciprocal "Petzval" radii of the individual elements should be as small as possible or equal to zero):

$$1/R_P=1/R_{P1}+1/1R_{P2}+\ldots+R_{PH}.$$

For this, "$R_{P1}$ with i=1 . . . n" indicates the "Petzval" radii of the individual lens elements with an index of "i." According to the sign convention, the signs for the "Petzval" radii of convergent lenses and divergent reflectors are positive while the "Petzval" radii of divergent lenses and convergent reflectors (concave mirrors) are negative. If a concave mirror is combined with a convergent lens or a divergent mirror (convex mirror), the "Petzval" surface of the overall system can be leveled.

In detail, the "Petzval" radii are calculated as follows:

$$R_{Plens}=n_{lens}\times f_{lens} \text{ (applies only to thin lenses)},$$

wherein "$n_{lens}$" is the refractive index of the lens, "$f_{lens}$" is its focal length, $R_{Preflector}=(-1)\times f_{reflector}$, and "$f_{reflector}$" is the focal length of the reflector.

In contrast to the convergent supplementary lens (M5 ff.) described above, the refractive power of the main reflector must be increased for the diffracting (hyperbolic) reflector (i.e., its local length must be decreased). The diffractive supplementary reflector generates, specifically, reduced chip images. This redaction of the reflector focal length is first disadvantageous, but is more than compensated for by the object-field leveling. It is advantageous that the supplementary reflector is entirely free of chromatic aberrations. By this measure, the entire length of the lens system is also reduced accordingly.

The supplementary lenses represent designs with which all of the changes caused by the lenses to the orientation and the shape of the light bundle emitted by the light source are distributed over numerous lens elements. This distribution of the changes to the orientation and/or the shape of the light bundle enables the reduction of the aberrations in the overall lens system and, thereby, causes the quality of the mapping to be improved.

In an embodiment, the supplementary lens is astigmatic. With this, the refractive power (i.e., the extent of the intended change in orientation) is greater in the vertical plane than in the horizontal plane. In this manner, light-source images can be generated having a greater vertical expansion than the horizontal expansion. As a result, the high-beam strips depicted in FIG. 2 also have a greater expansion in the vertical plane. The vertical diffraction is no longer generated only by the surface of the reflector, thus resulting in a greater optical efficiency (the relation of the luminous flux emitted by the light source to the luminous flux arriving in the desired light distribution) and a greater maximum illumination power.

In an embodiment, the convergent supplementary lens is an astigmatic convergent lens having different diffractive powers in the vertical and horizontal planes. In an embodiment, the convergent lens is designed as a convex/concave meniscus lens, wherein the concave surface faces the light source. In an embodiment, an additional divergent lens is disposed in the beam path.

The divergent lens, in an embodiment, includes organic or inorganic glasses having a high degree of color dispersion (i.e., having a lower "Abbe" number). The convergent lens includes, in this case, an organic or inorganic glass having a limited color dispersion (i.e., with a greater "Abbe" number). In an embodiment, the convergent lens and the divergent lens are connected to one another by an optical putty. The optical putty is a transparent organic thermoset material or elastomer the refractive index of which is as close as possible to the refractive indices of the lenses that are to be connected. Moreover, in an embodiment, the convergent lens is designed as a combined refractive/diffractive lens, and the diffractive structures are applied to the back surface of the lens facing the light source.

In an embodiment, the convergent lens is created as a plano-convex lens having a diffractive structure on the planar surface.

In an embodiment, the convergent supplementary lens is a half-shell/concave mirror (in particular, a hyperboloid). The half-shell reflector is disposed in the beam path such that the supplementary reflector reflects at an acute angle (i.e., substantially counter to the direction of the light beam of the main reflector). Because the supplementary reflector deflects the beam path, the light source radiates into the supplementary reflector and not into the main reflector. In an embodiment, the supplementary reflector is an astigmatic concave mirror having different diffractive powers in the vertical and horizontal planes.

In an embodiment, the lamp module—including the reflector, the light source with a cooling element, and (optionally) a convergent supplementary lens—is implemented such that it can be pivoted about a vertical axis by a motor. Pivotal lamp modules are known such that the details for implementing the drive and the bearing are not necessary here. With a lamp module that is pivotally implemented and otherwise in accordance with the invention, lighting function—such as dynamic curve lights, partial high beams (e.g. only dimmed in a strip), or marker lights (e.g., only bright in a strip)—can be realized. The pivotal property can selectively also be used for the adjustment of a vertical "light/dark" border. The pivotal axis is, in m embodiment, located in the vicinity of the common reflector focal point.

In an embodiment, the lamp module is equipped with a mechanical adjustment device for the horizontal setting of the "light/dark" border with which the light source and, if applicable; the supplementary lens can be displaced horizontally with respect to the reflector.

To now, the emphasis has been on a design in which the light source exhibits numerous light-emitting surfaces. The invention can also be used, however, in conjunction with light sources exhibiting only one light-emitting surface, insofar as the light-emitting surface has a longitudinal edge and an edge running at a right angle thereto (as is the case, in particular, with rectangular and quadratic light-emitting surfaces). To illustrate this, one can imagine (for example, in a purely qualitative manner) a single, coherent light-emitting surface (such as that in FIG. 1) as the sole light-emitting surface 12.5, as can be obtained as a sum, structure, or circuitry-based compilation of two neighboring light-emitting surfaces, three neighboring light-emitting surfaces, etc. or as a single surface of a sufficiently large chip or a block of chip segments. With a design of this type, it is also desirable that the light-emitting surface be mapped true to form and not mushroom-shaped or otherwise distorted.

With this background, an embodiment of the invention is a lamp module 22 for a motor-vehicle headlamp including a light source 10 that defines at least one luminous-flax- and light-emitting surface, an edge (in an intended use of the lamp module in a motor vehicle) oriented to the horizontal plane, and at least one other edge running at a right angle thereto. A reflector 24 is oriented and configured to map the light-emitting surface without generating an actual intermediate image in front of the lamp module. The reflector has at least two reflecting and strip-shaped facets 30, 32, 34 the longitudinal axes of which are oriented such that they are more parallel rather than transversal to the longitudinal edge of the light-emitting surface and, in each case, disposed at a spacing "R" from the light source where the light-emitting surface is mapped with the same mapping scale such that the light-emitting surface is mapped (in the intended use) with a horizontally running longitudinal edge and another edge that runs vertically.

In an embodiment, the common focal point lies in the center of an area of the light-emitting surfaces of the light source.

In an embodiment, the common focal point lies exactly between two adjacent light-emitting surfaces of the light source.

Furthermore, in an embodiment, the lamp module 22 exhibits a convergent lens for each of the light-emitting surfaces, which are disposed with spacing to one another. The convergent lenses are disposed such that a virtual image (generated by a convergent lens) of the light-emitting surface allocated to this convergent lens (lying behind the allocated light-emitting surface when seen from the location of the convergent lens) abuts, accordingly, the virtual image of a light-emitting surface adjacent to the light-emitting surface (generated by a convergent lens directly adjacent to the convergent lens).

The invention has been described above in an illustrative manner. It is to be understood that the terminology that has been used above is intended to be in the nature of words of description rather than of limitation. Many modifications and variations of the invention are possible in light of the above teachings. Therefore, within the scope of the appended claims, the invention may be practiced other than as specifically described above.

What is claimed is:

1. A lamp module (22) for a motor-vehicle headlamp, the lamp module comprising:

a light source (10) defining at least one light-emitting surface that emits a luminous flux and defines a substantially horizontally oriented longitudinal edge and at least one other edge running at a substantially right angle thereto; and a reflector (24) that maps the light-emitting surface without generating an actual intermediate image in front of the lamp module and defines at least two reflecting and strip-shaped facets (30, 32, 34) substantially longitudinal axes of which are more parallel rather than transversal to the longitudinal edge of the light-emitting surface and disposed at a spacing (R) to the light source where the light-emitting surface is mapped with the same mapping scale in front of the lamp module such that the light-emitting surface is mapped with a substantially longitudinal edge running substantially horizontally and another edge running substantially vertically.

2. The lamp module (22) according to claim 1, wherein the light source (10) defines at least two of the at least one light-emitting surface (12.1, 12.2, 12.3, 12.4, 12.5) that are disposed adjacently to one another in a row, wherein the longitudinal edge of the row is substantially horizontal, the longitudinal axes of the reflector (24) are oriented to be more parallel rather than transversal to the row of the light-emitting surfaces, and the light-emitting surfaces are mapped such that one of the light-emitting surfaces (12.1, 12.2, 12.3, 12.4, 12.5) is mapped as a substantially vertically oriented and coherent strip (18.1, 18.2, 18.3, 18.4, 18.5) in a light distribution formed as an image of the light-emitting surfaces.

3. The lamp module (22) according to claim 2, wherein each of the facets (30, 32, 34) defines a focal point and reflects divergent light arriving from the focal point as a light bundle defining substantially parallel light.

4. The lamp module (22) according to claim 3, wherein the local point of each of the arbitrary facets substantially coincides with the focal point of each of the other arbitrary facets in a common focal point.

5. The lamp module (22) according to claim 4, wherein an average of the spacing (R) of one of the facets from the common focal point (36) is substantially equal to an average of the spacing of each of the other facets from the common focal point and outer edges of the facets are spaced farther from the focal point than are inner edges of the facets.

6. The lamp module (22) according to claim 4, wherein a main beam direction of one of the arbitrary facets is substantially parallel to a main beam direction of each of the other arbitrary facets and is substantially parallel to a central, axis (28) of the reflector (24) that passes through the common focal point (36).

7. The lamp module (22) according to claim 6, wherein a main beam direction of the at least two light-emitting surfaces is oriented toward the facets and forms an angle "ϕ" with the central axis of less than 45°.

8. The lamp module (22) according to claim 6, wherein the row of the light-emitting surfaces is at a substantially right angle to the central axis (28) and substantially parallel to a longitudinal axis of the facets.

9. The lamp module (22) according to claim 8, wherein the facets are disposed directly adjacent to one another on an axis (27) substantially perpendicular to the longitudinal axis and central axis.

10. The lamp module (22) according to claim 4, wherein the common focal point lies in a substantial center of the light-emitting surfaces.

11. The lamp module (22) according to claim 4, wherein the common focal point lies substantially between two adjacent ones of the light-emitting surfaces.

12. The lamp module (22) according to claim 2, wherein the lamp module comprises further a convergent lens for each light-emitting surface, the light-emitting surfaces are disposed at a spacing to one another, and the convergent lenses are disposed such that a virtual image, generated from a convergent lens, of the light-emitting surface allocated to the convergent lens, which lies behind the allocated light-emitting surface when observed from a position of the convergent lens, abuts the virtual image of a light-emitting surface adjacent to the light-emitting surface, generated by a convergent lens directly adjacent to the convergent lens.

13. The lamp module (22) according to claim 1, wherein each of the facets a strip and paraboloid of revolution.

14. The lamp module (22) according to claim 1, wherein the lamp module comprises further a supplementary lens.

15. The lamp module (22) according to claim 14, wherein the supplementary lens is astigmatic.

16. The lamp module (22) according to claim 14, wherein the supplementary lens is a convergent mirror (52) disposed in a beam path between the light source and reflector (24).

17. The lamp module (22) according to claim 14, wherein the supplementary lens is a convergent lens (56) disposed in a beam path between the light source and reflector.

18. The lamp module (22) according to claim 17, wherein the convergent lens (56) reinforces a "bundling" effect of the reflector (24).

19. The lamp module (22) according to claim 14, wherein the supplementary lens defines a "Petzval" surface a curvature of which is counter to a curvature of a "Petzval" surface of the reflector.

20. A lamp module (22) for a motor-vehicle headlamp, said lamp module comprising:

a light source (10) defining at least two light-emitting surfaces (12.1, 12.2, 12.3, 12.4, 12.5) that emit a luminous flux and are disposed adjacently to one another in a substantially horizontal row; and a reflector (24) that maps the light-emitting surfaces without generating an actual intermediate image in front of the lamp module and defines at least two reflecting and strip-shaped facets (30, 32, 34) longitudinal axes of which are more parallel rather than transversal to the row of light-emitting surfaces and disposed at a spacing (R) to the light source where they map the light-emitting surfaces in front of the lamp module such that one of the light-emitting surfaces (12.1, 12.2, 12.3, 12.4, 12.5) is mapped as a substantially vertically oriented and coherent strip (18.1, 18.2, 18.3, 18.4, 18.5) in a light distribution formed as an image of the light-emitting surfaces.

* * * * *

UNITED STATES PATENT AND TRADEMARK OFFICE

CERTIFICATE OF CORRECTION

PATENT NO. : 8,801,248 B2
APPLICATION NO. : 13/767474
DATED : August 12, 2014
INVENTOR(S) : Brendle It is certified that error appears in the above-identified patent and that said Letters Patent is hereby corrected as shown below:

In the Claims

Column 12, line 53 claim 4 delete “local” and insert therefor --focal--.

Column 12, line 65 claim 6 delete “,” between “central” and “axis”.

Signed and Sealed this
Tenth Day of February, 2015

Michelle K. Lee

Michelle K. Lee
*Deputy Director of the United States Patent and Trademark Office*